US010232525B2

(12) United States Patent
Schloesser et al.

(10) Patent No.: US 10,232,525 B2
(45) Date of Patent: Mar. 19, 2019

(54) FILM PERFORATION DEVICE

(71) Applicant: DIOPASS SPRL, Jalhay (BE)

(72) Inventors: Frédéric Henry Schloesser, Jalhay (BE); Mireille Paula Fluzin, Jalhay (BE)

(73) Assignee: DIOPASS SPRL, Jalhay (BE)

( * ) Notice: Subject to any disclaimer, the term of this patent is extended or adjusted under 35 U.S.C. 154(b) by 0 days.

(21) Appl. No.: 15/317,184

(22) PCT Filed: Jun. 10, 2015

(86) PCT No.: PCT/EP2015/062884

§ 371 (c)(1),
(2) Date: Dec. 8, 2016

(87) PCT Pub. No.: WO2015/189238

PCT Pub. Date: Dec. 17, 2015

(65) Prior Publication Data

US 2017/0129122 A1 May 11, 2017

(30) Foreign Application Priority Data

Jun. 12, 2014 (BE) ..... 2014/0446
Jun. 12, 2014 (EP) ..... 14172179

(51) Int. Cl.
*B26F 1/20* (2006.01)
*B26D 7/20* (2006.01)
(Continued)

(52) U.S. Cl.
CPC ..... *B26F 1/20* (2013.01); *B26D 7/20* (2013.01); *B26F 1/44* (2013.01); *B65H 35/0006* (2013.01);
(Continued)

(58) Field of Classification Search
CPC ..... B26D 7/20; B26F 1/20; B26F 1/44; B26F 2001/4481; B65H 2301/5152; B65H 35/0006
(Continued)

(56) References Cited

U.S. PATENT DOCUMENTS 2,142,728 A * 1/1939 Kienzle ..... B26F 1/24 26/1
2,762,433 A * 9/1956 Russell ..... B01D 29/111 83/326
(Continued)

FOREIGN PATENT DOCUMENTS

FR 2986509 A1 8/2013
JP 2000301625 A 10/2000
WO 2013/019126 A1 2/2013

OTHER PUBLICATIONS

Written Opinion of the International Searching Authority dated Jul. 21, 2015, issued in corresponding International Application No. PCT/EP2015/062884, filed Jun. 10, 2015, 5 pages.
(Continued)

*Primary Examiner* — Ghassem Alie
(74) *Attorney, Agent, or Firm* — Christensen O'Connor Johnson Kindness PLLC

(57) ABSTRACT

A film perforation device including power supply means, a perforation element that has a perforation position and a withdrawal position, and means for receiving said film, wherein said film perforation device includes: a conveyor belt, having a planar surface penetrable by an above-mentioned perforation element which has a predetermined speed of movement and is arranged such as to receive the film unwinding onto the above-mentioned surface and convey same onto said surface at said predetermined speed in a predetermined direction; and a winch having a rotational axis, about which at least one supporting structure provided
(Continued)

with a perforation element is rotatably driven. In said perforation position, said perforation element perforates the film and at least partially penetrates the planar surface of said conveyor belt.

16 Claims, 6 Drawing Sheets

(51) Int. Cl.
*B26F 1/44* (2006.01)
*B65H 35/00* (2006.01)

(52) U.S. Cl.
CPC ..... *B26F 2001/4481* (2013.01); *B65H 2301/5152* (2013.01)

(58) Field of Classification Search
USPC ..... 83/331, 30, 343, 308, 863, 659
See application file for complete search history.

(56) References Cited

U.S. PATENT DOCUMENTS 3,630,513 A * 12/1971 Davidson, Jr. ..... B65B 15/02 270/37
3,747,447 A * 7/1973 Wisner ..... B26F 1/08 83/327
3,833,440 A * 9/1974 Kashiwa ..... B29C 51/24 156/243
4,060,017 A * 11/1977 Backlund ..... B23D 15/00 83/167
4,328,726 A * 5/1982 Pearl ..... B26D 5/005 33/1 M
4,345,496 A * 8/1982 Pearl ..... B26D 5/005 83/100
4,589,316 A * 5/1986 Lang ..... B26D 5/04 425/150
4,730,526 A * 3/1988 Pearl ..... B26D 7/018 198/689.1
4,888,966 A * 12/1989 Zapfel ..... C14B 1/34 69/41
4,928,562 A * 5/1990 Tanimura ..... B26F 1/0007 83/110
5,237,800 A * 8/1993 Omori ..... B65B 9/067 53/433
5,493,369 A * 2/1996 Sypula ..... G03G 15/11 399/240
5,740,709 A * 4/1998 Boston ..... B26D 11/00 83/308
6,105,492 A * 8/2000 Fergen ..... B31F 1/07 101/16
6,152,001 A * 11/2000 Faustmann ..... B26F 1/24 83/30
6,267,846 B1 * 7/2001 Halmschlager ..... D21F 9/003 162/203
6,699,806 B1 * 3/2004 Takeuchi ..... D21H 13/08 442/340
6,740,200 B2 * 5/2004 Seymour ..... D21F 11/00 162/111
6,913,570 B2 * 7/2005 Kehrle ..... B31D 3/005 493/451
9,334,122 B2 * 5/2016 Shoji ..... B65G 15/30
2007/0173163 A1 * 7/2007 Noelle ..... D04H 3/007 442/401

OTHER PUBLICATIONS

International Preliminary Report on Patentability dated Dec. 15, 2016, issued in corresponding International Application No. PCT/EP2015/062884, filed Jun. 10, 2015, 1 page.
International Search Report dated Jul. 21, 2015, issued in corresponding International Application No. PCT/EP2015/062884, filed Jun. 10, 2015, 5 pages.
Opinion Écrite de L'Administration Chargée de la Recherche Internationale dated Jul. 21, 2015, issued in corresponding International Application No. PCT/EP2015/062884, filed Jun. 10, 2015, 5 pages.

* cited by examiner

FILM PERFORATION DEVICE

The present invention relates to a device for perforating a roll-off film, comprising supply means for supplying the roll-off film, at least one perforating element that has a perforating position of said roll-off film and a withdrawn position, and receiving means for receiving said supplied perforated film.

Generally, such a device is coupled to a film wrapping machine provided to wrap containers such as bottles or cans. In this way, the perforating device integrated into the film wrapping machine makes it possible to procure a pre-perforated film before wrapping containers. The obtained film, which is preferably heat shrinkable, can then serve to wrap a series of containers.

Document FR 2,986,509 discloses such a perforating device integrated into a film wrapping machine. FIG. 3 of the document illustrates a perforating device that comprises a first roller equipped with a handled blade serving as a perforating element and a second roller provided with a slot arranged to receive the aforementioned blade. The first and second rollers are substantially contiguous such that the roll-off film is pinched, held and driven along a guide surface area.

Thus, when the film is supplied in the device, it is possible to arrive at the height of the two aforementioned contiguous rollers. When the film reaches the first and second rollers, it adopts the cylindrical surface of the second roller to be perforated by the blade, which is in the perforating position and arranged perpendicular to the surface of the film. In this way, the two rollers maintain and stretch the film on either side of the slot at the moment of the perforation, which can also complicate the control of the movement speed of the film. Upon leaving the perforation, the blade adopts its withdrawn position and the film continues its travel in the film wrapping machine.

This perforating device has the drawback of being able to cause tearing of the film. Indeed, the two rollers are contiguous and pinch the film so much that they may cause it to be torn before, during or after perforation.

Furthermore, the shape of the perforation obtained on the film using the disclosed device is limited by the shape of the cutting object of the first roller, which must be capable of being housed in the predefined shape of the slot of the opposite roller. In the aforementioned document, the only cutting object used is a blade that must be received by the slot. The use of the taught device is therefore greatly limited for users, who are forced to perforate their film using a single perforating element offering a single perforating shape.

Lastly, it is clear that the location of the perforations is predefined and that the perforations are obtained with the same spacing distance. Therefore, when the distance between two perforations must be modified, it is essential to substitute the first and second rollers with rollers having a larger or smaller diameter.

The known device is therefore limited to offering the user a single type of pattern with a single possible spacing type.

Lastly, the disclosed device makes access to the film difficult because the two rollers are contiguous. Therefore, when an element remains blocked in the slot of the second roller, the access to the film remains difficult. The maintenance of such a device is therefore also greatly limited.

For the aforementioned reasons, it appears that the disclosed device does not make it possible to obtain a high-quality perforation with reliable precision and guaranteed reliability provided over time. The usage flexibility of such a device is furthermore greatly limited, while the needs of users in this field continue to increase.

The invention aims to offset the drawbacks of the state of the art by providing a versatile perforating device, simultaneously having a flexibility expected by users, being reliable, and producing precise, guaranteed and reproducible perforations.

At the current time, there is a real need to provide a perforating device capable of offering a plurality of perforations with varied shapes and that is able to guarantee the perforation of a film unrolled continuously, for example on a printing line.

To resolve the aforementioned problems, according to the invention, provided is a perforating device, as indicated at the beginning of this document, characterized in that it further comprises:

- a conveyor belt having a planar surface that can be penetrated by at least one of the aforementioned perforating elements, having a predetermined movement speed and being arranged to receive the roll-off film on the aforementioned surface and to convey it thereon at said predetermined speed in a predetermined direction,
- a reel having a rotation axis positioned parallel to said planar surface, at a distance therefrom and perpendicular to said predetermined movement direction of said film on said planar surface of the conveyor belt and around which at least one support structure provided with at least one aforementioned perforating element is driven in revolution, and
- in that, in said perforating position of the roll-off film, said at least one perforating element perforates the film and at least partially penetrates through the planar surface of said conveyor belt.

The conveyor belt of the perforating device according to the present invention offers several advantages.

First of all, it has a planar surface that makes it possible to receive and transport the roll-off film at a predetermined speed and in a predetermined direction. Thus, when the roll-off film reaches the planar surface of the conveyor belt, the latter is driven substantially at the predetermined movement speed of the conveyor belt and in the predetermined direction thereof. Thus, the film is unrolled over a planar surface, which greatly facilitates its perforation by the perforating element(s). Indeed, at the time of the perforation, the film remains held by the conveyor belt with no possibility of being stretched by the perforating elements. The perforation is therefore precise, since it is done on a substantially planar surface and the perforating element is such that, in the perforating position, not only does it traverse the film, but it furthermore penetrates the conveyor belt, whereof it traverses the planar surface.

Thus, the penetrable planar surface of the conveyor belt facilitates the perforation of the film that it transports, and it may be penetrated by any perforating element, irrespective of its shape.

The reel according to the invention is particularly advantageous in that its rotation axis is arranged at a distance from the planar surface of the conveyor belt. One does away with the use of two contiguous rollers that pinch the film and risk tearing it during its unrolling. Furthermore, the arrangement of the reel away from the conveyor belt makes access to the film easier, unlike the state of the art using two contiguous rollers. Therefore, in case of maintenance or breakdown of the device, the arrangement of each element forming the perforating device according to the invention makes it easier to access the film.

Furthermore, said at least one support structure of the reel can be provided with at least one perforating element that can easily be substituted by another manner of adapting the shape of the perforations in the film.

Thus, it is obvious that the perforating device according to the invention makes it possible to produce precise, reliable and reproducible perforations with guaranteed quality.

Within the meaning of the present invention, the expression "penetrable planar surface" of the conveyor belt means a conveyor belt that has, on its surface, a material allowing it to be penetrated by a perforating element according to the present invention. Thus, the material on the surface of the conveyor belt may assume the form of a brush, bristles, felt, foam, a combination thereof, or any other material able to be penetrated, without limiting the shape of the penetrating element.

Advantageously, said conveyor belt has a first predetermined speed vector on said planar surface and said at least one perforating element has, in the perforating position, a second predetermined speed vector that is identical to said first predetermined speed vector.

In the context of the present invention, "speed vector" refers to a vector that is defined by a value, a sense and a direction. Practically speaking, the "first speed vector" relates to the conveyor belt. When the conveyor belt is moved and receives the film to be conveyed, the "first speed vector" has a sense and a direction corresponding to the movement sense of the film and the conveyor belt. The predetermined speed of the conveyor belt defines the intensity (the value) of this "first speed vector". Thus, the conveyor belt moves with the film at a certain speed, in a sense and a predefined direction that are represented by this "first speed vector".

The perforating element has many speed vectors, since it rotates around the rotation axis of the reel. However, the speed vector of interest in the context of the present invention relates to the so-called "second speed vector", which pertains to that of the perforating element in the perforating position. The "second speed vector" is steered and oriented in the same sense as the "first speed vector" of the conveyor belt. Thus, in the perforating position, the perforating element reaches the film at the same speed as the latter, which prevents having to pinch and stop the film during the perforation. The "first speed vector" according to the invention is parallel to the "second speed vector".

This has the advantage that the perforation is done without having to maintain or stretch the film during the perforation, since the perforating element reaches the surface of the film needing to be perforated at the same movement speed as the latter, while all of the film is supported by the conveyor belt.

In one particular embodiment, said at least one perforating element has a substantially planar surface arranged to be in contact with the planar surface of the conveyor belt. During perforation of the film, the surface of the perforating element, the surface of the film and the planar surface of the conveyor belt thus extend substantially in the same plane. This has the result that, after perforation, the at least one perforating element supported by the support structure is easily removed from the film while easily leaving the plane of the planar surface of the conveyor belt when it is driven in revolution around the axis of the reel. In this way, the perforating element thus leaves the film and the planar surface of the conveyor belt to adopt its withdrawn position without risking tearing the film, which may continue to travel easily.

Furthermore, the advantage of this embodiment lies in the change of at least one perforating element, which is made easy. Indeed, each perforating element may have a different cutout shape on a substantially planar surface, which facilitates the replacement by other cutting shapes that advantageously also have a planar surface. The device according to the invention is therefore not limited to a single cutting shape.

According to one preferred embodiment of the present invention, said at least one perforating element comprises a front face provided with cutting elements and a back face arranged to be received by said at least one support structure.

Advantageously, said at least one support structure has a pivot axis around which at least one perforating element rotates. In this way, the perforating elements according to the invention rotate synchronously relative to the pivot axis of the support structure and the rotation axis of the reel.

According to one advantageous embodiment of the device according to the invention, the latter comprises at least one additional reel positioned across from an additional planar surface of the conveyor belt, intended to receive the film. In this way, the device may for example comprise a conveyor belt situated between two reels to produce the perforations on the roll-off film in two successive locations.

Quite advantageously, the device according to the invention comprises at least one additional conveyor belt, and at least one additional planar surface thereon to receive the additional film. In this way, the perforating device according to the invention may for example comprise a reel situated between two conveyor belts to produce the perforations on the roll-off film in two successive locations.

Preferably, said conveyor belt is mounted on at least two cylinders arranged to rotate. In this way, the conveyor belt is supported by at least two cylinders, preferably four cylinders, so as to provide a sufficiently planar surface of the conveyor belt, for example between two of these cylinders.

Preferably, the axis of the reel has first and second ends each provided with a side wall and at least one aforementioned support structure extending from one side wall to the other.

In one particularly advantageous embodiment of the device according to the invention, said device comprises at least one guide for adjusting the spacing between each perforation pattern. This embodiment will be preferred when the perforating device according to the invention comprises a reel situated between two conveyor belts.

Furthermore, in one particular embodiment, the predetermined speed of the conveyor belt is comprised between 20 and 400 meters per minute (m/min), preferably between 100 and 350 m/min, more preferably between 150 and 350 m/min, advantageously between 200 and 350 m/min.

Advantageously, said at least one perforating element has a geometric shape chosen from the group consisting of a semi-circle, a circle, part of the circle such as the arc of circle, a square, a straight line, a curved line, a rectangle, a triangle, or combinations thereof.

This particular embodiment has an especially advantageous interest for the device according to the invention because it meets the needs of users wishing to have a versatile perforating device. Indeed, the at least one perforating element can be substituted as desired in order to obtain the desired perforation shape. For example, if the user wishes to produce a square perforation, he need only use the perforating element having a square geometric shape provided with the device, fasten it on the support structure and operate the device in order to obtain the selected pattern on the perforable film. Furthermore, the replacement of the perforating element is made easy by the device according to the invention, since not only is access to the film guaranteed, but access to at least one perforating element is easy.

Other embodiments of the perforating device according to the invention are indicated in the appended claims.

The present invention also relates to a printing line comprising the perforating device according to the present invention.

The perforating device is such that it may be incorporated into a printing line, which is particularly unexpected in light of the current perforating devices that cannot provide perforation at the same speed as that at which the film unrolls.

Other embodiments of the printing line according to the invention are indicated in the appended claims.

The present invention also relates to a film wrapping machine comprising the perforating device according to the invention.

Other embodiments of the film wrapping machine according to the invention are indicated in the appended claims.

Other features, details and advantages of the invention will emerge from the description provided below, non-limitingly and in reference to the appended drawings.

In the figures, identical or similar elements bear the same references.

Figure 1:
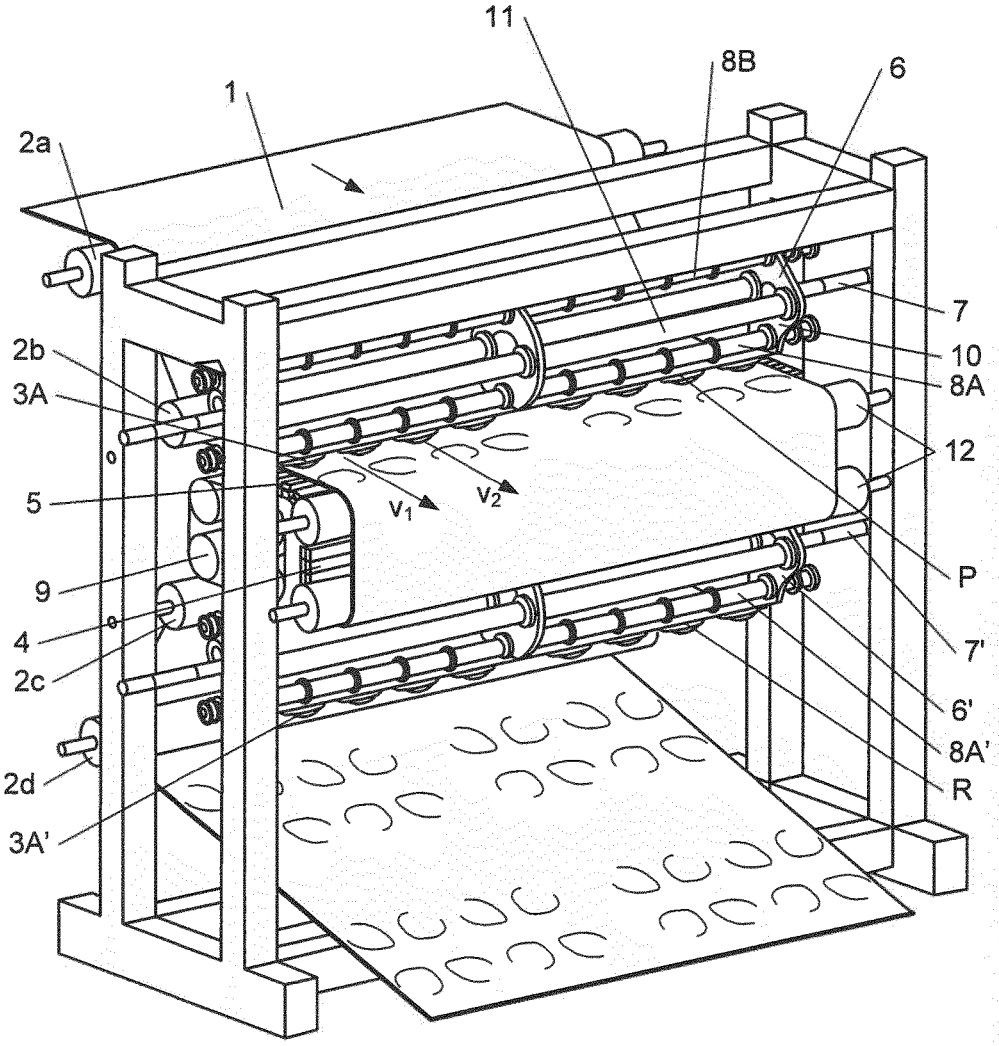
FIG. 1 is a perspective view of one embodiment of the perforating device according to the invention.
Figure 2:
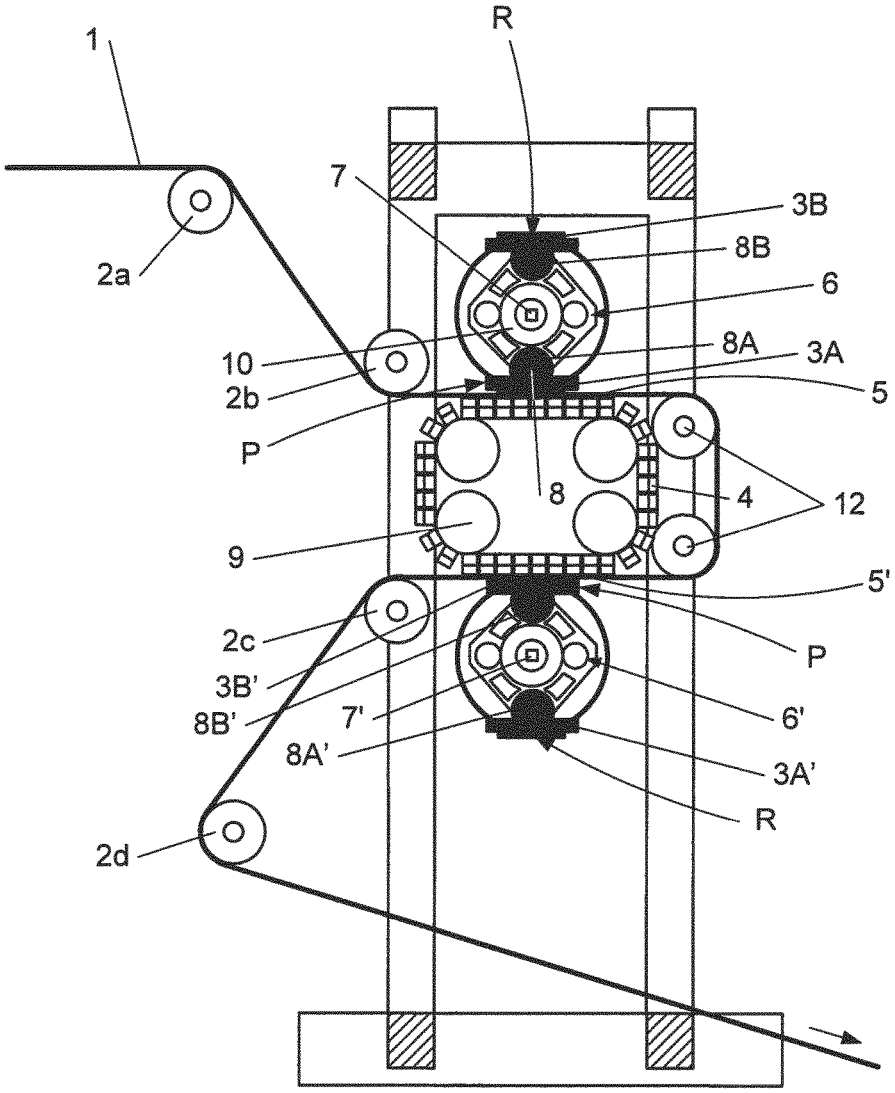
FIG. 2 is a side view of the perforating device shown in FIG. 1.

FIGS. 1 and 2 show a perforating device in which a roll-off film is supplied by two supply means 2*a*, 2*b* toward a conveyor belt 4 that has a penetrable planar surface 5. The conveyor belt 4 is mounted on 4 cylinders 9, but may also be supported by at least 2 cylinders 9. At least one of these cylinders 9 is capable of driving the movement of the belt 4 in a known manner, not shown, and at a predetermined speed. The film 1 is received on this belt 4 and is conveyed by the latter at this speed.

As illustrated in FIGS. 1 and 2, four reels 6 and 6' are situated on either side of the conveyor belt, two reels 6 being located above the first planar surface 5 of the conveyor belt 4 and two reels 6' being arranged below the additional planar surface 5' of the belt 4. Each reel 6 and 6' has a rotation axis 7 and 7' around which a first support structure 8A, 8A' comprising four perforating elements 3A, 3A' and a second support structure 8B, 8B' comprising four perforating elements 3B, 3B' rotate in revolution. The rotation axis 7 and 7' of each reel 6 and 6' is parallel to the surface of the belt 4, and is therefore arranged perpendicular to the movement direction D of the film 1, at a distance therefrom.

It is also possible to note that the rotation axes 7 and 7' of each reel 6 and 6' have, in this example, a first end and a second end each provided with a side wall 10. Each support structure 8A, 8A', 8B, 8B' of a reel 6 and 6' extends from one side wall to the other of the rotation axis 7 and 7'.

In the embodiment illustrated in FIGS. 1 and 2, the reels 6 and 6' situated above or below the belt 4 are connected to one another by a central wall that makes it possible to stiffen the structure of the reel. Thus, two primary reels 6 and 6', situated on either side of the conveyor belt 4, can be formed by the connection of two reels 6, 6' using a central wall. In this way, each primary reel thus comprises a side wall at each of its ends and a central wall at its center.

It is not precluded that the device according to the invention has, on either side of the conveyor belt 4, four reels 6 and 6', and therefore two reels 6 above the belt 4 and two reels 6' below the belt 4, each reel comprising side walls at their ends. The reels 6 and 6' are therefore preferably independent of one another.

Furthermore and according to one preferred embodiment of the present invention, the device may also comprise two reels 6 and 6' situated on either side of the conveyor belt 4, one above the first planar surface 5 of the conveyor belt 4, and the other below the additional planar surface 5' of the belt 4.

Each perforating element 3A, 3B, 3A' and 3B' illustrated in FIGS. 1, 2 has a front face provided with cutting elements, such as needles or a blade, and a substantially planar back face. In the perforating position P, the front face of each perforating element 3A, 3B, 3A' and 3B', preferably the cutting elements of each perforating element 3A, 3B, 3A' and 3B', can rest on the penetrable planar surface 5 of the conveyor belt 4. In this way, when the film 1 is conveyed by the belt 4, the latter is maintained between the perforating elements 3A, 3B, 3A' and 3B', in the perforating position P, and the planar surface 5, 5' on which the film 1 conveyed by the belt 4 rests.

In one particular embodiment, the perforating elements 3A of the first support structure 8A of the reel 6 situated above the conveyor belt 4 perforate the film 1, when they are in the perforating position P, while the perforating elements 3B of the second support structure 8B of the reel 6 are not provided to perforate the film in this preferred configuration. Thus, the perforating elements 3B' of the reel 6', situated below the conveyor belt 4, are those provided to perforate the film, while the perforating elements 3A' are not arranged to perforate said film 1.

Quite advantageously, when the four perforating elements 3A of the first support structure 8A of the reel 6 are in the perforating position 4, the four perforating elements 3B of the second support structure 8B, situated opposite the first support structure 8A, are in the withdrawn position R. Thus, the four perforating elements 3A of the first support structure 8A perforate the film 1 to then rotate by 360° and perforate it again. The four perforating elements 3B of the second support structure 8B, in this particular embodiment, simply act as a counterweight to the perforating elements 3A of the first support structure 8A. The perforation provided using this particular embodiment is then still more precise.

In the aforementioned particular arrangement, the front faces 8 of the perforating elements 3A of the first support structure 8A of the reel 6 are oriented toward the film 1. Opposite the front faces A of the perforating elements 3A of the first support structure 8A, the back faces B of the perforating elements 3B of the second support structure 8B are oriented toward the film 1 to prevent these perforating elements 3B from coming into contact with the film 1. Advantageously, the perforating elements 3B of the second support structure 8B can be useful in case of replacement of the perforating elements 3A of the first support structure 8A. This is also applicable to the reel 6' arranged below the conveyor belt 4.

It is understood that the perforating elements 3B of the second support structure 8B can be substituted by another element so as to be able to support the weight of the first support structure 8A that comprises the perforating elements 3A. This is also valid for the reel 6 situated below the conveyor belt 4.

Furthermore, it is also possible to consider that all of the perforating elements 3A, 3B, 3A' and 3B' are arranged to perforate the film 1.

Figure 3:
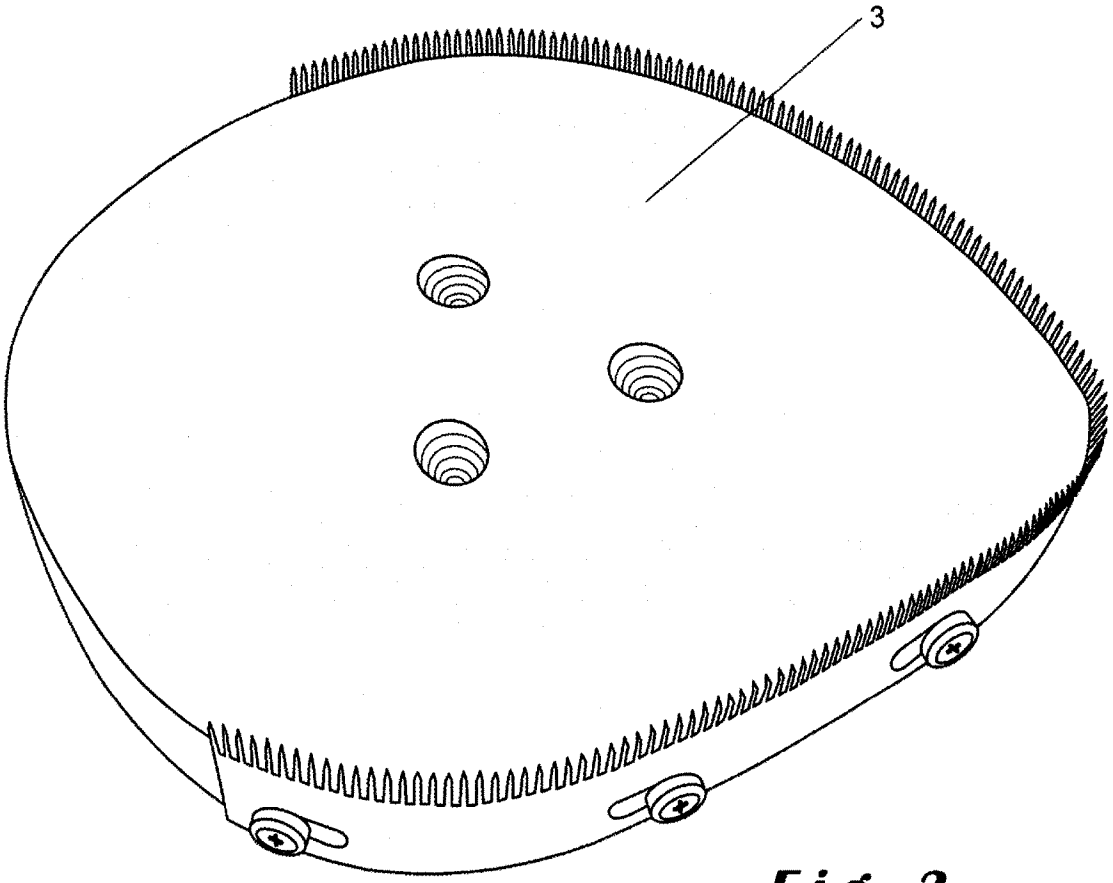
FIG. 3 is a perspective illustration of an example perforating element having cutting needles on the periphery.

In the example illustrated in FIGS. 1 and 2, the perforating element has a pattern in the shape of ¾ circles (FIG. 3). It is understood that the shapes of the perforations can vary and for example assume another shape such as a circular, rectilinear, curved, rectangular, square, triangular shape, or any other geometric shapes.

It is also possible to replace the shape of the perforating element 3A, 3B, 3A' and 3B' with another shape, for example to modify the shape of the precut or to simply replace a worn perforating element 3.

Thus, after perforation, the film 1 has a first row of perforations that comprises eight ¾ circles and a second row comprising eight ¾ circles.

As shown in FIGS. 1 and 2, receiving means 12 are present in a cylindrical form. In this way, the latter receive the perforated film 1 in order to guide it toward the additional planar surface 5' of the conveyor belt 4.

In the embodiment described in FIGS. 1 and 2, the film 1 can be unrolled at a speed comprised between 20 and 400 meters per minute (m/min), preferably between 100 and 300 m/min, more preferably between 150 and 350 m/min, advantageously between 200 and 350 m/min.

During operation, the perforating device is supplied with a perforable film 1 using rotating cylinders 2*a*, 2*b* that bring it up to the first planar surface 5 of the conveyor belt 4. The first planar surface 5 of the conveyor belt 4 has a first speed vector $V_1$. The sense and direction of the first speed vector $V_1$ are those corresponding to the movement sense of the film 1, when it is transported by this first planar surface 5 of the belt 4. Lastly, the intensity of the first vector $V_1$ is equal to that of the predetermined movement speed of the conveyor belt 4, and therefore that of the roll-off film 1.

When the film 1 reaches the first planar surface 5 of the belt 4, the perforating elements 3A are in the perforating position P and perforate the latter while being perpendicular to the movement sense D of the film 1. Therefore, in the perforating position P, the perforating elements 3A have a second speed vector $V_2$ identical to the first speed vector $V_1$ of the first penetrable planar surface 5 of the belt 4.

FIGS. 1 and 2 make it possible to shed light on the two positions of the perforating elements 3A, 3B, 3A' and 3B', i.e., the perforating position P and the withdrawn position R.

For example, when the perforating elements 3A and 3B are set in rotation relative to the first planar surface 4 of the belt 5, they move away from, then successively come closer to the surface 5 of the belt 4 that conveys the film 1. Thus, when the perforating elements 3B are in the withdrawn position R relative to the roll-off film 1, they are moved away relative to the first planar surface 5 and the perforation of the film 1 does not occur. Conversely, when the perforating elements 3A reach the first planar surface 5 of the belt 4, they adopt a perforating position P that allows them to perforate the film 1.

At the end of perforation, the perforating elements 3A or 3B adopt their withdrawn position R and the film 1 thus continues its movement up to the two receiving cylinders 12, which guide it toward the second planar surface 5' of the conveyor belt 4 where the second perforating line is produced. During the second perforation, the perforating elements 3B' are parallel to the film and perforate it while penetrating the second planar surface 5' of the conveyor belt 4 as described above to produce the first line of perforations.

Furthermore, when the perforating elements 3B' of the reels 6', situated below the conveyor belt 4, perforate the film, they also have a second speed vector $V_2$ identical to the first speed vector $V_1$. This time, the sense of the second vector $V_2$ of the perforating elements 3B' of the second support structure 8B' is opposite that of the perforating elements 3A of the first support structure 8A of the reel 6 located above the conveyor belt 4.

This has the advantage of being able to integrate the perforating device according to the invention into a printing line where it is necessary to be able to perforate the film 1 while maintaining a predetermined speed without having to stop the printing line.

Thus, and as illustrated in FIGS. 1 and 2, upon each perforation, the conveyor belt 4 serves as a support for the perforating elements 3A, 3B, 3A' and 3B' that can easily perforate the film successively by traversing the first planar surface 5, then the second (additional) planar surface 5' of the conveyor belt 4 while maintaining a constant movement speed of the film.

The film 1 thus obtained may be used to wrap bottles, cans or any other container. Once wrapped, the removal of a bottle or can is made easy owing to the perforations present on the film located across from the bottles or cans. Thus, the removal of a bottle or can is done without necessarily having to tear all of film 1, which maintains the bottles or cans remaining in the wrapping sufficiently. The film 1 used in the device according to the invention can be of any type and function. However, a heat shrinkable wrapping film 1 is preferred.

FIG. 3 shows a detailed view of a perforating element 3, which is intended to represent an exemplary embodiment of perforating elements 3A, 3B, 3A', or 3B', and which may be positioned on a corresponding support structure, 8A, 8A', 8B and 8B' of the perforating device according to the invention.

Advantageously, the support structure 8A, 8A', 8B and 8B' of the device may contain a receiving zone on which the perforating element 3 is fastened. The perforating element 3 has a substantially planar surface that is provided with three orifices that make it possible to fasten it to the support structure 8A, 8A', 8B and 8B' of the perforating device according to the invention. It is of course understood that the perforating element 3 can quite simply be clipped on the support structure 8A, 8A', 8B and 8B' to facilitate its replacement. Thus, the support structure 8A, 8A', 8B and 8B' can comprise receiving means for the perforating elements 3. Furthermore, the support structure 8A, 8A', 8B and 8B' may comprise slots, striations or grooves in which the perforating element 3 can slide, which facilitates the replacement of the perforating element 3.

Furthermore and as shown in FIG. 3, the perforating element 3 comprises, on the periphery, cutting needles that trim part of the peripheral surface. In this way, it is possible to form a pattern in the form of ¾ circles using such a perforating tool.

Figure 4:
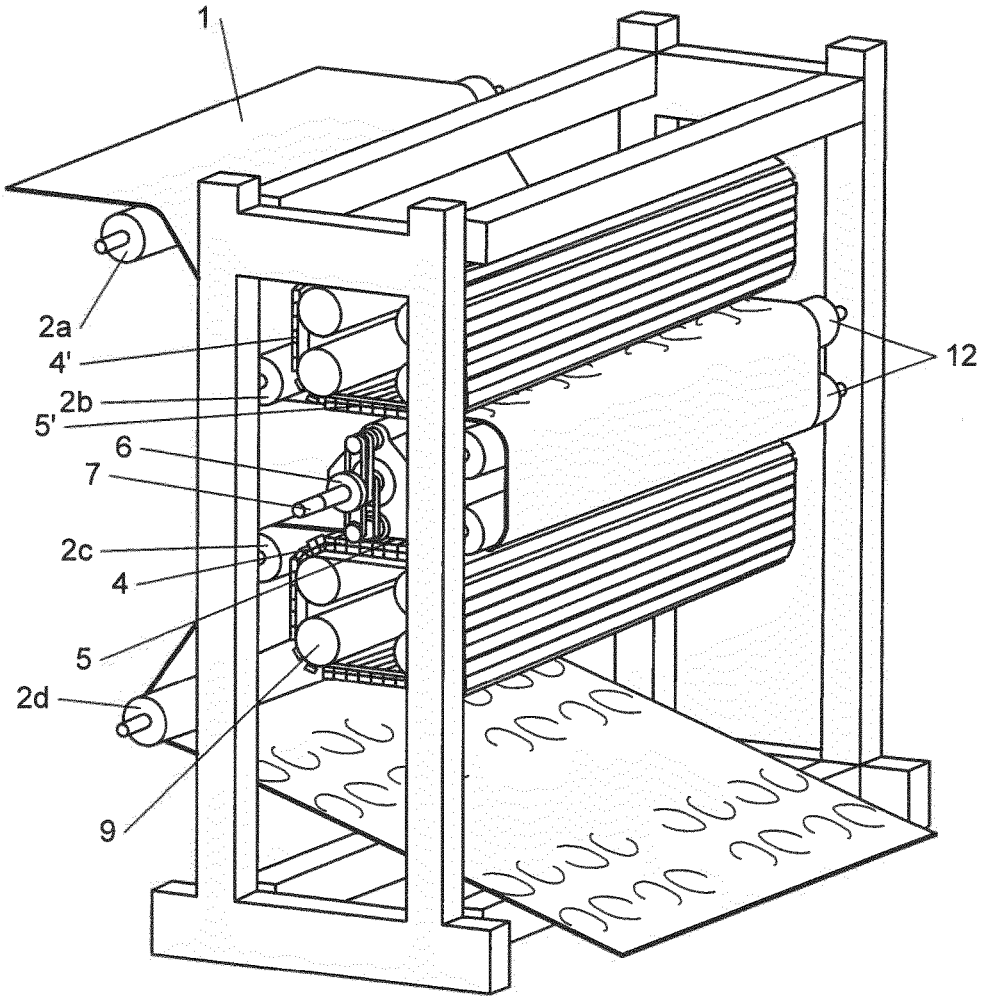
FIG. 4 is a perspective view of an alternative embodiment of the device according to the present invention.

FIG. 4 shows one preferred embodiment of the device according to the present invention and illustrates all of the elements described in FIGS. 1 and 2. However, the arrangement of the parts is different in that the device comprises a reel 6 situated between the first and second conveyor belts 4, 4'. The first conveyor belt 4' is situated above the reel 6, and therefore its first planar surface 5' is arranged to receive the roll-off film 1. The second conveyor belt 4 is situated below the reel 6 and its first planar surface 5 is also arranged to receive and convey the roll-off film 1.

Practically, the intake of the film 1 in the device is done using two rotating supply cylinders 2*a*, 2*b*. The film 1 is thus received by the first planar surface 5' of the first conveyor belt 4'. The reel 6 comprises two support structures 8 that respectively comprise a perforating element 3 (not shown). Thus, when the film 1 is received on the first penetrable planar surface 5' of the first conveyor belt 4', it is perforated by the perforating elements 3, which are situated, in the perforating position, below the first conveyor belt 4'. The perforated film 1 is brought to the two receiving cylinders 12, which orient it toward the first planar surface 5 of the second conveyor belt 4, situated below the reel 6. Again, the perforating element begins again, but this time, the perforating elements 3 are in the perforating position such that they perforate the film 1 while being situated just above the second conveyor belt 4.

Lastly, at the perforation outlet, the perforated film 1 is received and reoriented by two receiving cylinders 2*c*, 2*d* that receive the film 1. Thus, the film 1 has a series of patterns in the shape of ¾ circles.

Each perforating element 3 has the form of a ¾ circle. It is possible to replace the shape of the perforating element 3 with another shape, for example to modify the shape of the precut or simply to replace a used perforating element 3.

Thus, at the end of the perforations, the film 1 has a first and second row of perforations, where each row comprises eight ¾ circles. Each perforating element 3 has the shape of a ¾ circle.

The film 1 thus obtained can be used to wrap bottles, cans or any other container.

This embodiment is particularly advantageous because it simply requires placing a single reel 6 arranged between two conveyor belts 4 to perforate the roll-off film 1.

This preferred embodiment further facilitates the integration of the perforating device according to the invention into a printing line that requires continuous unrolling of the film 1 at relatively high speeds.

Figure 5:
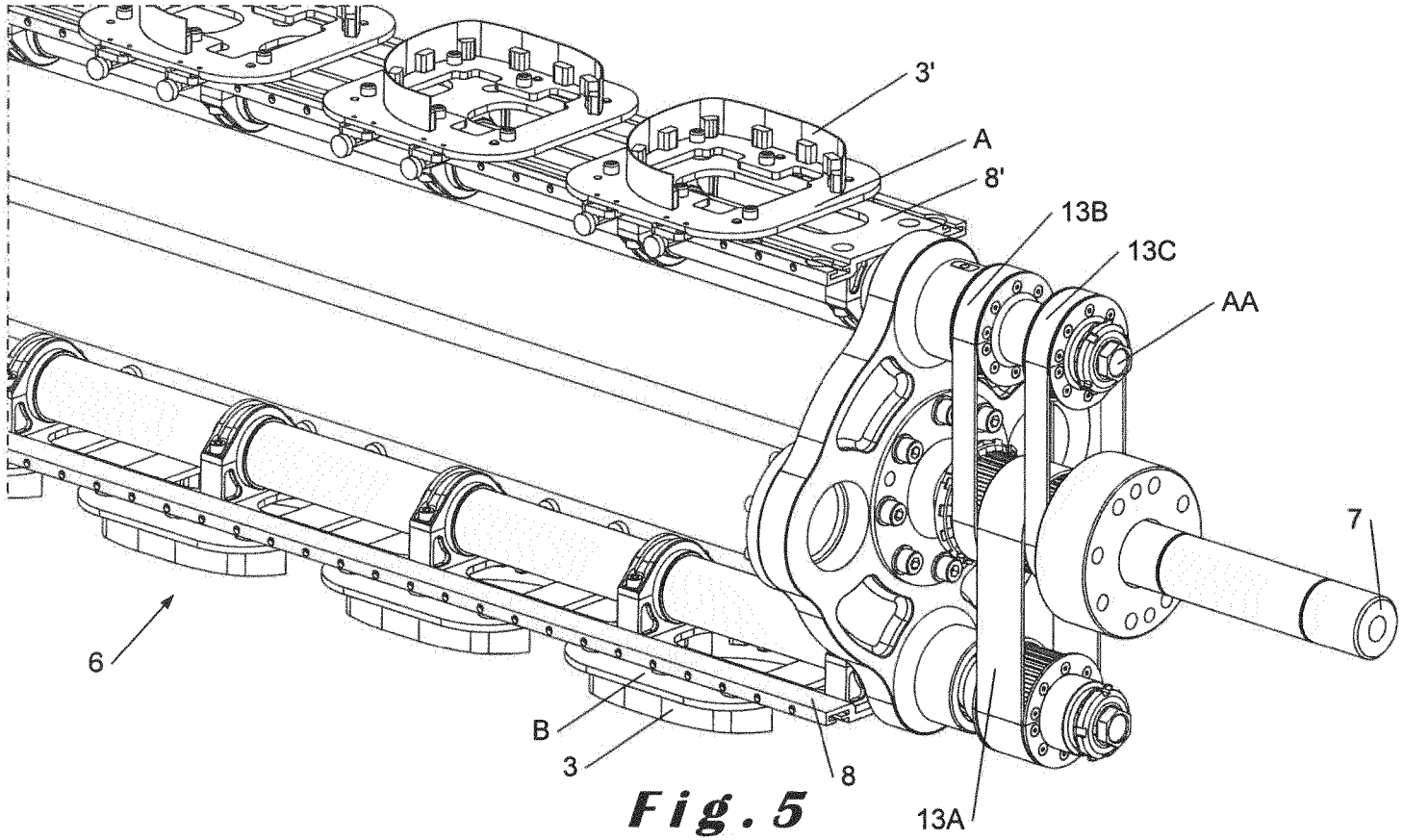
FIG. 5 is a view of one advantageous reel of the device according to the invention when the perforating elements are in the perforating position.
Figure 6:
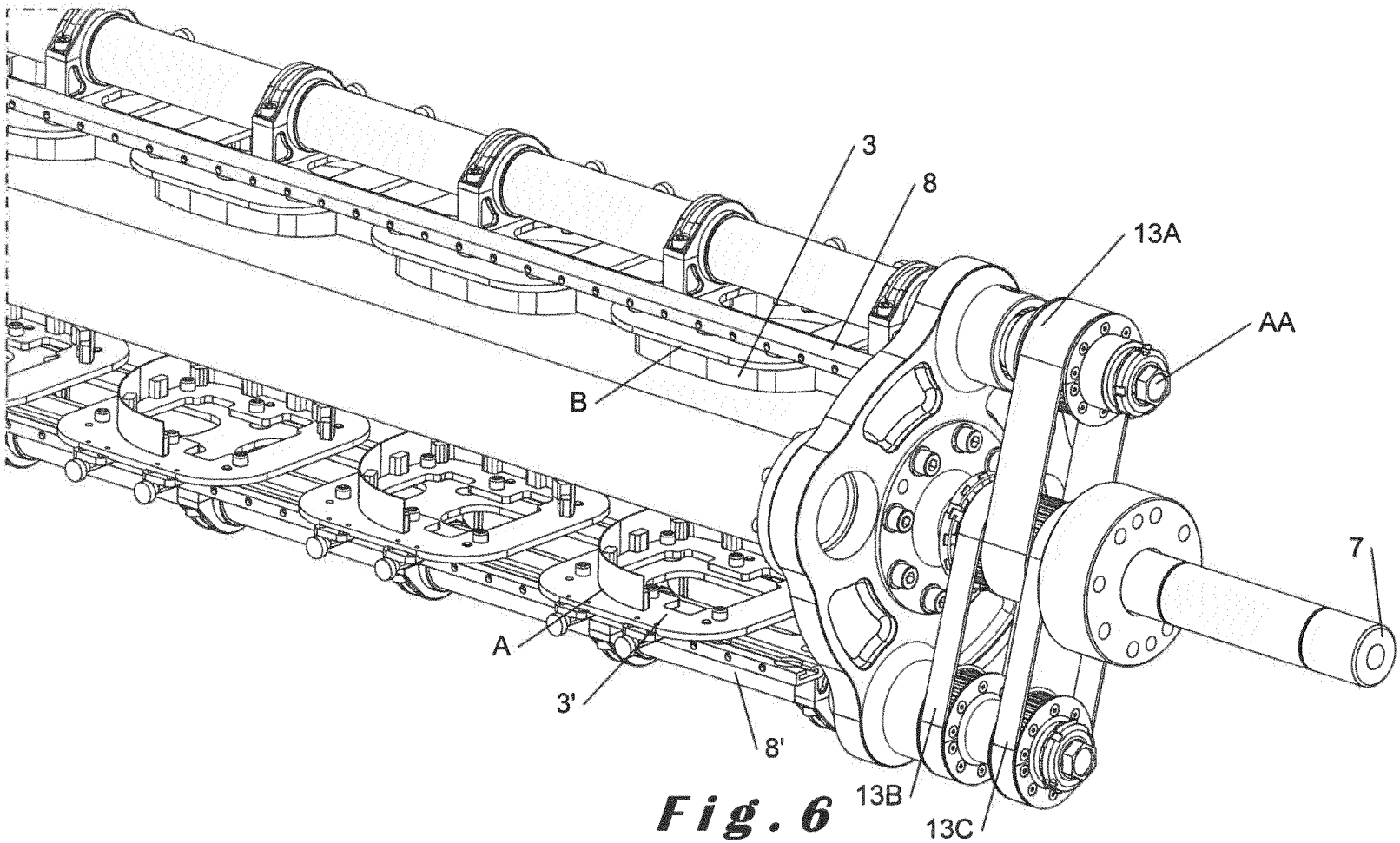
FIG. 6 is an illustration of the reel of FIG. 5 when the perforating elements are in the withdrawn position.

FIGS. 5 and 6 illustrate one advantageous reel 6 of the perforating device according to the invention that comprises a first support structure 8 and a second support structure 8', which have a pivot axis AA. Each support structure 8 and 8' comprises perforating elements 3 and 3' that are arranged to rotate around the pivot axis AA of the corresponding support structure 8 and 8'. The reel 6 has a rotation axis 7 around which the perforating elements 3 and 3' also rotate that rest on the support structures 8 and 8'.

The rotation axis 7 and the pivot axes AA of the support structures 8 and 8' are connected to one another using three belts 13 as shown in FIGS. 5 and 6. However, the number of belts used may be at least 2.

Thus, in the case at hand, the first belt 13A connects the pivot axis AA of the first support structure 8 to a fixed pulley, preferably concentric relative to the rotation axis 7 of the reel 6. The second (13B) and third 13C belts connect the pivot axis AA of the second support structure 8' to the fixed pulley, preferably concentric relative to the rotation axis 7 of the reel 6.

As illustrated in FIGS. 5 and 6, each perforating element 3 and 3' has a front face A provided with a cutting element, such as a blade, and a back space B provided to be fixed on the support structure 8 and 8'.

The reel 6 is rotated using at least one motor (not shown) that drives the rotation axis 7 of the reel 6.

In FIG. 5, the perforating elements 3 of the first support structure 8 are in the perforating position P. At this time, the front faces A of the perforating elements 3 are oriented toward the film 1 (not shown) to perforate it as explained in the preceding figures. At the same time, the perforating elements 3' of the second support structure 8' are situated opposite the first support structure and their front face is situated in the opposite direction from that of the front faces of the perforating elements 3 of the first support structure 8.

When the perforating elements 3 and 3' of the first and second support structures 8 and 8' continue to rotate, each perforating element 3, 3' rotates around itself and relative to its pivot axis AA. In this way, the rotation of the perforating elements 3, 3' is done synchronously, like a satellite rotation.

In this advantageous embodiment of the device according to the invention, the perforating elements 3, 3' perform a double rotation, one relative to the pivot axis of their support structure 8, 8' and the other relative to the rotation axis 7 of the reel 6.

FIG. 6 illustrates the perforating elements 3, 3' of FIG. 5 after a 180° rotation, which corresponds to a withdrawn position R. In this embodiment, it is possible to see that the front faces A of the perforating elements 3, 3' face one another. Thus, the perforating elements 3' of the second support structure 8' cannot perforate the film 1' (not shown) when it reaches its height, given that their back face faces the film 1.

Again, during a new 180° rotation of the reel 6, the perforating elements 3, 3' rotate synchronously such that the perforating elements 3 of the first support structure 8 reach the film 1 (not shown) to perforate it using cutting elements such as cutting blades.

Thus, this particularly advantageous embodiment can be integrated into the perforating device according to the invention to increase the cutting precision.

Advantageously, the reel shown in FIGS. 5 and 6 will preferably be integrated into the perforating device illustrated in FIGS. 1 and 2.

It is understood that the present invention is in no way limited to the embodiments described above and that changes may be made thereto without going beyond the scope of the appended claims.

In the context of the present invention, the perforating device according to the invention may comprise several reels 6 and several conveyor belts 4.

A conveyor belt 4 and 4' according to the invention may advantageously be supported by at least two cylinders or any other element that makes it possible to form a substantially planar surface 5 and 5' of the conveyor belt 4 and 4'.

Advantageously, the perforating device may comprise at least one guide 12 such as a rotating cylinder to adjust the spacing between each perforating pattern. Thus, the position of the guide makes it possible to control the distance between each perforating pattern.

Preferably, the device according to the present invention comprises at least 1 reel, preferably 2 reels, more preferably four reels. When the device according to the present invention comprises four reels, two reels are advantageously arranged on either side of a conveyor belt and the two reels are preferably connected to one another at their end using a central wall that makes it possible to stiffen the obtained structure.

It is understood that the device according to the invention may use at least one motor or any equivalent means to operate the elements of the device.

The invention claimed is:

1. A device for perforating a roll-off film comprising:

supply means for supplying said roll-off film, at least one perforating element that has a perforating position of said roll-off film and a withdrawn position, receiving means for receiving said supplied roll-off film, when perforated, a conveyor belt having a planar surface arranged to receive said roll-off film on said penetrable planar surface and to convey said roll-off film thereon in a predetermined direction, and a reel having a rotation axis positioned parallel to said planar surface, at a distance therefrom and perpendicular to said predetermined movement direction of said roll-off film on said planar surface of said conveyor belt and at least one support structure provided with at least one aforementioned perforating element, said at least one support structure having a pivot axis, wherein said rotation axis of said reel and said pivot axis of said at least one support structure are connected by at least one belt, said support structure is driven in revolution around said rotation axis of said reel, while in said perforating position of said roll-off film, said at least one perforating element perforates said roll-off film and at least partially penetrates through said planar surface of said conveyor belt, and said conveyor belt has a first predetermined speed vector on said planar surface, while said at least one perforating element has, in the perforating position, a second predetermined speed vector that is identical to said first predetermined speed vector.

2. The perforating device according to claim 1, wherein said at least one perforating element has a substantially planar surface arranged to be in contact with penetrable said planar surface of the conveyor belt.

3. The perforating device according to claim 1, wherein said at least one perforating element comprises a front face provided with cutting elements and a back face arranged to be received by said at least one support structure.

4. The perforating device according to claim 1, wherein said at least one support structure has a pivot axis around which at least one perforating element rotates.

5. The perforating device according to claim 1, comprising at least one additional reel positioned across from an additional penetrable planar surface of the conveyor belt, intended to receive said roll-off film.

6. The perforating device according to claim 1, comprising at least one additional conveyor belt, and at least one additional penetrable planar surface thereon to receive the roll-off film.

7. The perforating device according to claim 1, wherein said conveyor belt is mounted on at least two cylinders arranged to rotate.

8. The perforating device according to claim 1, wherein the axis of the reel has first and second ends each provided with a side wall and at least one aforementioned support structure extending from one side wall to the other.

9. The device according to claim 1, comprising at least one guide for adjusting the spacing between each perforation pattern.

10. The device according to claim 1, wherein said predetermined speed of the conveyor belt is comprised between 20 and 400 meters per minute (m/min), preferably between 100 and 350 m/min, more preferably between 150 and 350 m/min, advantageously between 200 and 350 m/min.

11. The device according to claim 1, wherein said at least one perforating element has a geometric shape chosen from the group consisting of a semi-circle, a circle, part of the circle such as the arc of circle, a square, a straightline, curved line, a rectangle, a triangle, and combinations thereof.

12. A printing line comprising the perforating device according to claim 1.

13. A film wrapping machine comprising the perforating device according to claim 1.

14. The device according to claim 1, wherein the planar surface of the conveyor belt is defined by a brush, bristles, or any combination thereof.

15. A device for perforating a roll-off film comprising:

at least one supply cylinder for supplying said roll-off film, at least one perforating element that has a perforating position of said roll-off film and a withdrawn position, at least one receiving cylinder for receiving said roll-off film when perforated, a conveyor belt having a planar surface arranged to receive said roll-off film on said planar surface and to convey said roll-off film thereon in a predetermined direction, and a reel having a rotation axis positioned parallel to said planar surface, at a distance therefrom and perpendicular to said predetermined movement direction of said roll-off film on said planar surface of said conveyor belt and at least one support structure provided with at least one aforementioned perforating element, said at least one support structure having a pivot axis, wherein said rotation axis of said reel and said pivot axis of said at least one support structure are connected by at least one belt, sad support structure is driven in revolution around said rotation axis of said reel, while in said perforating position of said roll-off film, said at least one perforating element perforates said roll-off film and at least partially penetrates through said planar surface of said conveyor belt, and said conveyor belt has a first predetermined speed vector on said planar surface, while said at least one perforating element has, in the perforating position, a second predetermined speed vector that is identical to said first predetermined speed vector.

16. A device for perforating a roll-off film comprising:

supply means for supplying said roll-off film, at least one perforating element that has a perforating position of said roll-off film and a withdrawn position, receiving means for receiving said supplied roll-off film, when perforated, a conveyor belt having a planar surface arranged to receive said roll-off film on said planar surface and to convey said roll-off film thereon in a predetermined direction, and a reel having a rotation axis positioned parallel to said planar surface, at a distance therefrom and perpendicular to said predetermined movement direction of said roll-off film on said planar surface of said conveyor belt and at least one support structure provided with at least one aforementioned perforating element, said at least one support structure having a pivot axis, wherein said rotation axis of said reel and said pivot axis of said at least one support structure are connected by at least one belt, said support structure is driven in revolution around said rotation axis of said reel, while in said perforating position of said roll-off film, said at least one perforating element perforates said roll-off film and at least partially penetrates through said planar surface of said conveyor belt, the material of said planar surface of the conveyor belt being a brush or bristles or a combination thereof, and said conveyor belt has a first predetermined speed vector on said planar surface, while said at least one perforating element has, in the perforating position, a second predetermined speed vector that is similar to said first predetermined speed vector.

* * * * *